United States Patent [19]

Choi

[11] 4,009,578

[45] Mar. 1, 1977

[54] METHOD FOR PREVENTING FLUID MIGRATION IN COAL SEAMS

[75] Inventor: Dai S. Choi, Ponca City, Okla.

[73] Assignee: Continental Oil Company, Ponca City, Okla.

[22] Filed: July 14, 1975

[21] Appl. No.: 595,938

[52] U.S. Cl. ..... 61/36 R

[51] Int. Cl.[2] ..... E02D 3/14

[58] Field of Search ..... 61/35, 36; 166/281, 166/307

[56] References Cited

UNITED STATES PATENTS

| | | | |
|---|---|---|---|
| 2,675,083 | 4/1954 | Bond et al. | 166/307 X |
| 3,163,010 | 12/1964 | Carpenter | 61/36 R |
| 3,845,632 | 11/1974 | Slobod et al. | 61/36 R |
| 3,878,686 | 4/1975 | Hageman et al. | 61/36 R |

FOREIGN PATENTS OR APPLICATIONS

| | | | |
|---|---|---|---|
| 700,847 | 12/1964 | Canada | 61/36 R |

*Primary Examiner*—Paul R. Gilliam
*Assistant Examiner*—David H. Corbin

[57] ABSTRACT

A method for preventing fluid migration in coal seams by forming a substantially fluid impermeable zone across the fluid migration path by positioning at least one borehole in the coal seams in a direction generally parallel to the direction of fluid migration; injecting anhydrous hydrogen chloride or ammonia into the coal seams through the boreholes; and thereafter plugging the boreholes to prevent retrograde flow of the hydrogen chloride or ammonia.

10 Claims, 3 Drawing Figures

METHOD FOR PREVENTING FLUID MIGRATION IN COAL SEAMS

This invention relates to the control of fluid migration in coal seams.

This invention more particularly relates to a method for preventing fluid migration in coal seams by injecting substantially anhydrous hydrogen chloride or ammonia into such coal seams.

In the production of coal, a continuing problem is the presence of explosive or combustible gases in coal mine areas. These gases flow from the coal seams through fissures, cracks, and the like along the cleavage planes of the coal. The gas flow from the coal seams through such cleavage planes results in the presence of substantial volumes of explosive or combustible gaseous materials in coal mines which must be removed by extensive air-conditioning, ventilation, and the like. In spite of extensive efforts to ventilate coal mines adequately, the occurrence of explosions as a result of the presence of such gases is common, and as a result, a continuing effort has been devoted to the development of means for preventing the entry of such gases into coal mines.

One such attempt is shown in U.S. Pat. No. 3,845,632 to Slobod and Burcik, which describes a method for obstructing or blocking the flow of methane gas from a coal seam by injecting a gelable silicic acid composition into cracks and fissures which exist in the coal at the cleavage planes. A method for blocking gas flow is shown in U.S. Ser. No. 542,149, filed Jan. 20, 1975, by Davis. This method discloses a procedure for fracturing across the cleavage planes and injecting a plugging material into the coal seam.

While each of these methods offers substantial advantages, each also suffers certain disadvantages. It has not been found that the migration of fluid in coal seams is prevented by forming a substantially fluid impermeable zone across the fluid migration path by positioning at least one borehole in the coal seams in a direction generally parallel to the direction of fluid migration; injecting a substantially anhydrous material selected from the group consisting of hydrogen chloride and ammonia at a pressure sufficient to force the material into the coal seam surrounding the borehole but at a pressure less than the fracturing pressure of the coal seam in an amount equal to from about 0.01 to about 5.0 weight percent based on the weight of the coal contacted by the material and, plugging the borehole to prevent retrograde flow of the material.

Figure 1:
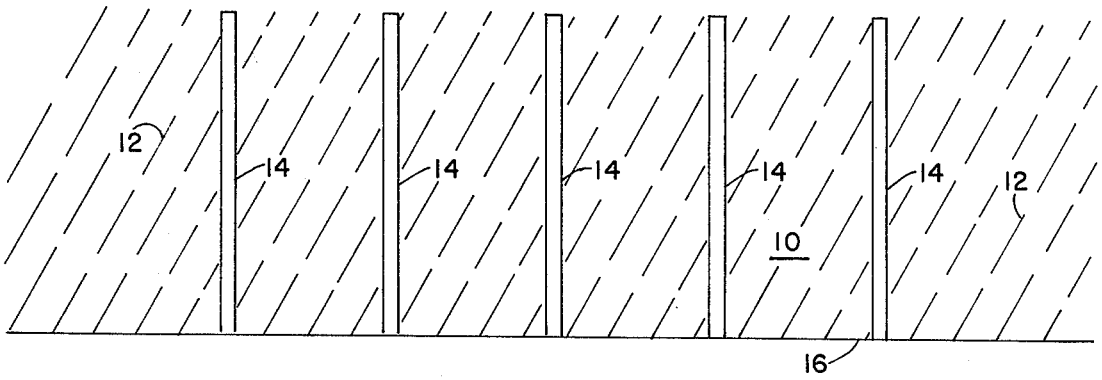
FIG. 1 is a top view of a coal seam penetrated by boreholes prior to treatment by the method of the present invention.

FIG. 1 shows a coal seam 10 having cleavage planes 12 penetrated by boreholes 14. Boreholes 14 extend inwardly into coal seam 10 in a direction substantially parallel to cleavage planes 12 from surface 16. Boreholes 14 typically extend distance of at least about 20 feet into the coal seam. The depth of the boreholes is more often from about 3 to about 1,500 feet with the length commonly being from about 50 to about 100 feet. The holes may be of any suitable diameter for the injection of the HCl or ammonia; however, it has been found that commonly used diameters vary from about 1 inch to about 6 inches. The material is injected as either a liquid or a gas but preferably is substantially anhydrous. It has been found that quantities of water up to about 5 weight percent do not defeat the objectives of the present invention; however as noted before, it is preferred that the material injected be anhydrous. It has been found advantageous in some instances that the material be diluted with an inert diluent selected from the group consisting of air, hydrogen, carbon dioxide, nitrous oxide, methane, nitrogen, and the like. When such diluents are used, it is preferable that the diluent be present in amounts up to about 50 weight percent based on the total mixture.

Figure 2:
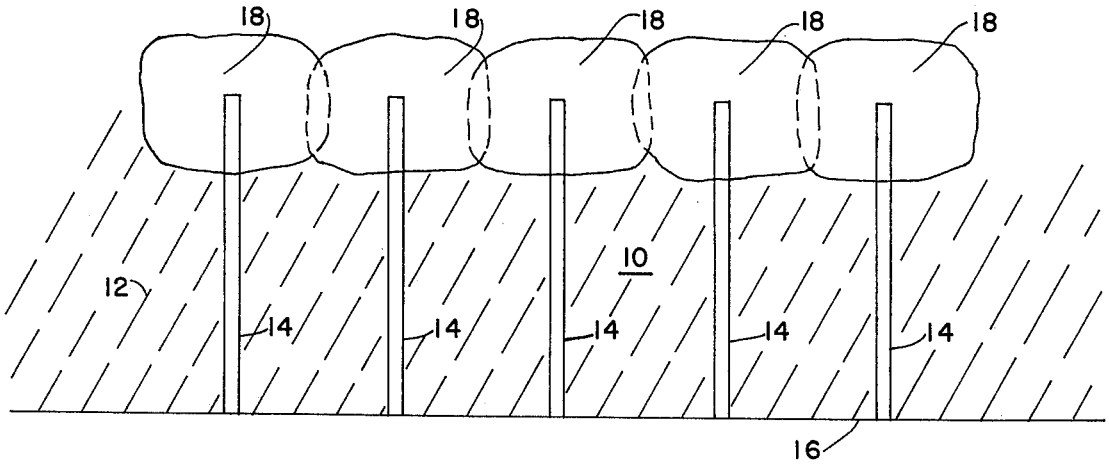
FIG. 2 is a top view of the same formation after treatment with anhydrous HCl or ammonia.
Figure 3:
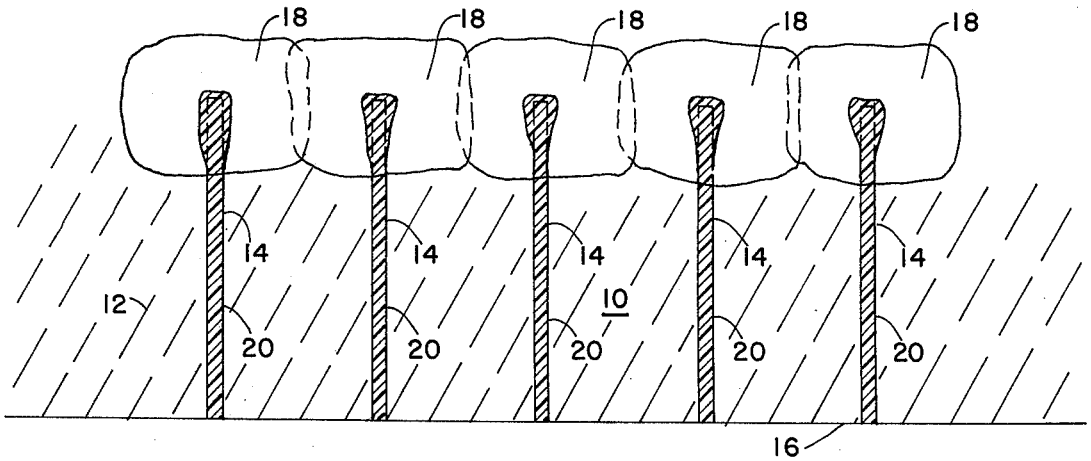
FIG. 3 is a top view of the same formation after plugging of the boreholes.

The hydrogen chloride or ammonia is injected into the coal seam through the boreholes at a pressure sufficiently high to force the material into the coal seam as shown in FIG. 2 but at a pressure below the fracturing pressure of the coal seam. Commonly used pressures are from about 50 to about 1,000 psi, although it should be understood that the pressures used will vary widely depending upon the particular coal seam, the depth of the coal seam in the earth, and the like. Upon completion of the treatment, the borehole is desirably plugged by injecting a polymeric material 20 into the borehole as shown in FIG. 3. The material 20 may be injected as a liquid, solid, or a gas; however, it is preferred that the material injected be capable of penetrating small openings such as fissures and the like so that the borehole is completely plugged. In many instances rubber packing and the like may be used in conjunction with such materials. Some suitable materials are sodium silicates, polyacrylamides, thermoplastic resins such as amide polymers, thermosetting resins such as phenolic novolac (acid catalyzed), phenolic resol (base catalyzed), polymerized furfural, epoxy resins, furan plastics, urea formaldehyde resins, magnesium oxysulfate cements, and the like. Of these materials, the sodium silicate, polyacrylamides, magnesium oxysulfate cements, and polymerized furfural are preferred. Sodium silicate is gelled by contact with HCl and results in an effective seal at the junction of the impregnated outer diameter of the borehole. The injection of furfural prevents a convenient method for sealing HCl treated coal seams since the polymerization of furfural is catalyzed by HCl. The magnesium oxysulfates are fire resistant and are effective as plugging agents. Such plugging methods and materials are well known to those skilled in the art and need not be discussed further.

In many instances, HCl is preferred over ammonia since it tends to be retained more readily in the coal seam than does the ammonia. With either of the materials, a sufficient amount is injected to result in contacting areas 18 (FIG. 2) of the coal seam surrounding the borehole to the extent that the zones contacted overlap thus forming a substantially impermeable barrier to fluid passage. Both HCl and ammonia tend to fracture the coal contacted thereby resulting in an expansion of the coal thus expanding the coal into a compressed state so that it is substantially fluid impermeable. The use of the present method is simple and results in effectively sealing coal seams to fluid migration. The use of ammonia and HCl to fracture and expand coal has been shown heretofore in U.S. Ser. No. 402,699 filed by Choi et al, Sept. 3, 1974, and U.S. Ser. No. 472,569 filed May 23, 1974, by Yang et al.

As is obvious to those skilled in the art, the placement and number of boreholes and the like will vary considerably depending upon the particular formation and the properties of the formation such as the porosity of the formation, the communication between the cleavage planes, and the like. Since various coal seams are unique, it is believed that no further discussion of borehole spacing or the like is necessary since such determinations are well known to those skilled in the art. It is necessary, however, that the areas contacted by the HCl or ammonia substantially overlap so that the fluid impermeable zone is substantially complete across the fluid migration pathway.

Desirably, the HCl or ammonia is injected in an amount sufficient to modify the physical properties of the coal in the zone contacted so that the coal is expanded into a compressed, fractured, fluid impermeable state. The amount of HCl or ammonia used can vary widely. In particular, it is obvious that gross overkills can be used, but is has been found that in most instances from about 0.01 to about 5 weight percent, based on the amount of coal contacted, of the HCl or ammonia is sufficient. A preferred range is about 0.3 to about 1.0 weight percent.

Having thus described certain preferred embodiments of the invention, it is pointed out that the foregoing description of preferred embodiments is illustrative rather than limiting in nature and that many variations and modifications are possible within the scope of the present invention. It is anticipated that many such variations and modifications may be considered obvious or desirable to those skilled in the art upon a review of the foregoing description of preferred embodiments.

Having thus described the invention, I claim:

1. A method for preventing fluid migration in a coal seam, said method consisting essentially of forming a substantially fluid impermeable zone across the fluid migration path by a. positioning at least one borehole in said coal seam in a direction generally parallel to the direction of fluid migration;

b. injecting a substantially anhydrous material selected from the group consisting of hydrogen chloride and ammonia at a pressure sufficient to force said material into the coal seam surrounding said borehole, but less than the fracturing pressure of said coal seam, in an amount equal to from about 0.01 to about 5.0 weight percent based on the weight of the coal contacted by said material; and c. plugging said borehole to prevent retrograde flow of said materials.

2. The method of claim 1 wherein a plurality of said boreholes are used.

3. The method of claim 2 wherein said boreholes extend from 3 to about 1,500 feet into said coal seam.

4. The method of claim 1 wherein said material contains up to about 5 weight percent water.

5. The method of claim 4 wherein said material is diluted with a diluent selected from the group consisting of air, hydrogen, carbon dioxide, nitrous oxide, methane, nitrogen and mixtures thereof.

6. The method of claim 1 wherein said borehole is plugged by injecting a polymeric material selected from the group consisting of sodium silicate, polyacrylamides, thermoplastic resins, thermosetting resins, phenolic resol, polymerized furfural, epoxy resins, furan plastics, urea formaldehyde resins, magnesium oxysulfate cements, and mixtures thereof.

7. The method of claim 6 wherein said polymeric material is selected from the group consisting of sodium silicate, polyacrylamides, magnesium oxysulfate cements, and polymerized furfural.

8. The method of claim 1 wherein said material is hydrogen chloride.

9. The method of claim 8 wherein said borehole is plugged with polymerized furfural.

10. The method of claim 1 wherein said material is ammonia.

* * * * *